US011829094B2

(12) United States Patent
Suzuki

(10) Patent No.: US 11,829,094 B2
(45) Date of Patent: Nov. 28, 2023

(54) IMAGE FORMING APPARATUS

(71) Applicant: CANON KABUSHIKI KAISHA, Tokyo (JP)

(72) Inventor: Koji Suzuki, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/882,960

(22) Filed: Aug. 8, 2022

(65) Prior Publication Data

US 2023/0079997 A1 Mar. 16, 2023

(30) Foreign Application Priority Data

Sep. 14, 2021 (JP) ..... 2021-149480

(51) Int. Cl.
*G03G 15/00* (2006.01)
*G03G 15/20* (2006.01)

(52) U.S. Cl.
CPC ..... *G03G 15/6579* (2013.01); *G03G 15/2028* (2013.01)

(58) Field of Classification Search
CPC ..... G03G 15/2028; G03G 15/6579
See application file for complete search history.

(56) References Cited

U.S. PATENT DOCUMENTS

2005/0207762 A1* 9/2005 Funabiki ..... G03G 15/5062 399/15
2005/0207768 A1* 9/2005 Suzuki ..... G03G 15/5062 399/49

FOREIGN PATENT DOCUMENTS

JP 2018189728 A 11/2018

* cited by examiner

*Primary Examiner* — Victor Verbitsky
(74) *Attorney, Agent, or Firm* — ROSSI, KIMMS & McDOWELL LLP

(57) ABSTRACT

An image forming apparatus includes an image forming unit including an image bearing member, and a transfer unit, a fixing unit, a re-conveyance unit, a detection unit, and a control unit configured to execute a booklet mode while creating a booklet, the booklet including a first sheet having a first surface and a second surface opposite to the first surface, and a second sheet having a third surface arranged adjacent to the second surface of the first sheet. The control unit is configured to control the image forming unit such that, in the booklet mode, a toner image is transferred to the second surface before a toner image is transferred to the first surface of the first sheet, and a toner image to be formed on the third surface of the second sheet is corrected based on an information of the second surface detected by the detection unit.

9 Claims, 10 Drawing Sheets

BEFORE CORRECTION

AFTER CORRECTION

AFTER PRINTING SECOND SHEET

AFTER PRINTING FIRST SHEET

IMAGE FORMING APPARATUS

BACKGROUND OF THE INVENTION

Field of the Invention

The present invention relates to image forming apparatuses for forming images on sheets.

Description of the Related Art

Japanese Patent Application Laid-Open Publication No. 2018-189728 proposes an image forming apparatus that is capable of performing image adjustment to reduce positional deviation and density unevenness in image areas that are arranged adjacent to one another after postprocessing. According to the image forming apparatus, at first, a chart for adjustment is printed prior to outputting a job that includes postprocessing by taking the contents of the postprocessing into consideration. A plurality of register marks are printed on the chart for adjustment.

Then, the image forming apparatus determines a deviation of image position from a target printing position by reading the position of the plurality of register marks, and computes a correction value of image. Next, the image forming apparatus outputs a job, performs image adjustment based on the computed correction value, and transfers the adjusted image on a sheet.

However, the image forming apparatus disclosed in Japanese Patent Application Laid-Open Publication No. 2018-189728 requires to print and read the chart for adjustment before outputting a job and to compute the correction value for image adjustment. Therefore, a preparation operation before outputting the job takes a long time and productivity is deteriorated thereby.

SUMMARY OF THE INVENTION

According to an aspect of the present invention, an image forming apparatus includes an image forming unit configured to form a toner image on a sheet, the image forming unit including an image bearing member configured to bear the toner image, and a transfer unit configured to transfer the toner image borne on the image bearing member, a fixing unit configured to fix the toner image transferred to the sheet by the transfer unit onto the sheet, a re-conveyance unit configured to reverse front and rear surfaces of the sheet on which the toner image has been transferred by the transfer unit and to convey the sheet again to the transfer unit, a detection unit configured to detect an information of the sheet being conveyed, and a control unit configured to execute a booklet mode while creating a booklet, the booklet including a first sheet having a first surface and a second surface opposite to the first surface, and a second sheet having a third surface arranged adjacent to the second surface of the first sheet, the second sheet being conveyed subsequently to the first sheet. The control unit is configured to control the image forming unit such that, in the booklet mode, a toner image is transferred to the second surface before a toner image is transferred to the first surface of the first sheet, and a toner image to be formed on the third surface of the second sheet is corrected based on an information of the second surface detected by the detection unit.

Further features of the present invention will become apparent from the following description of exemplary embodiments with reference to the attached drawings.

DESCRIPTION OF THE EMBODIMENTS

Entire Configuration

Figure 1:
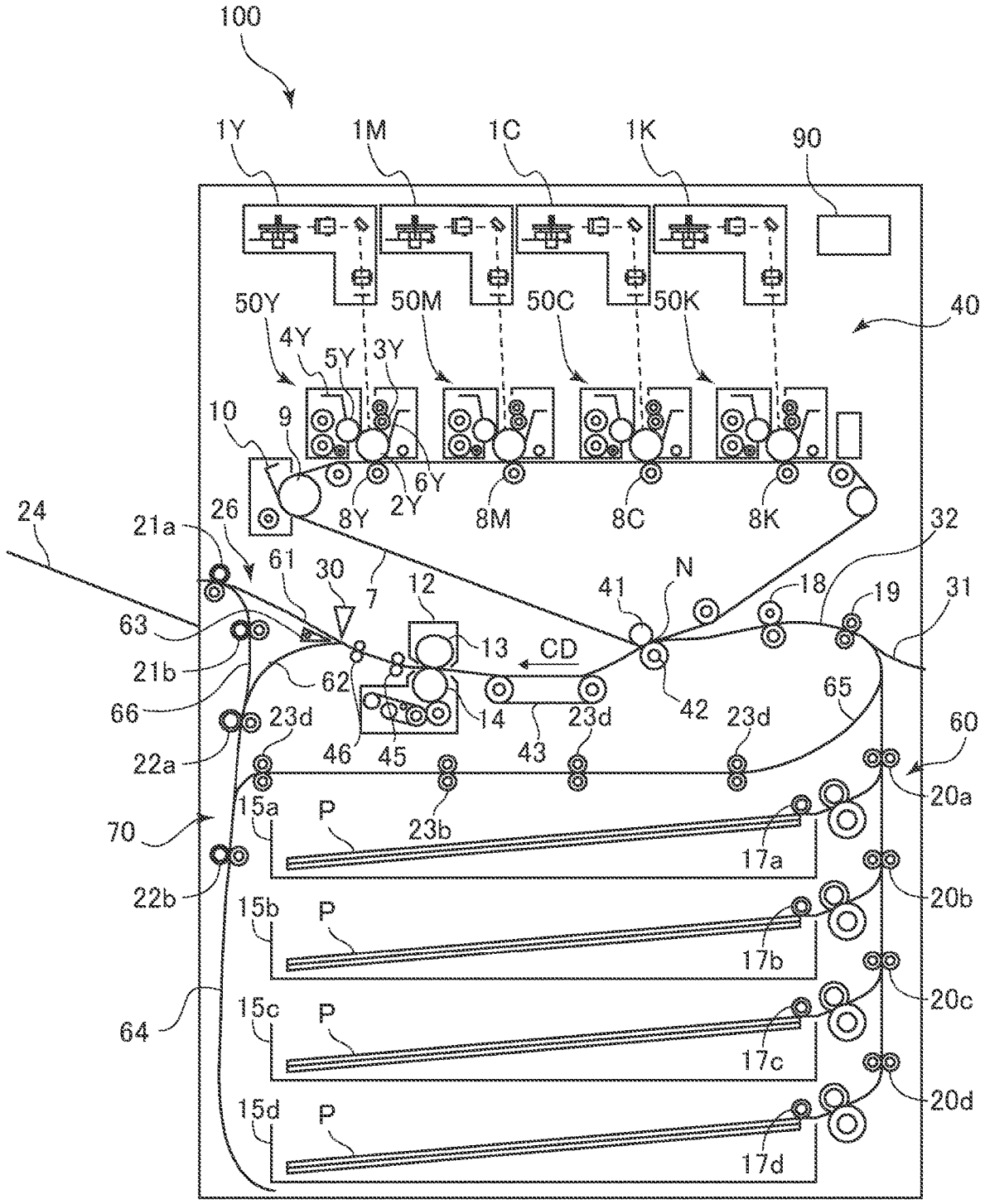
FIG. 1 is an entire schematic diagram illustrating a printer according to a present embodiment.

A printer 100 serving as an image forming apparatus according to the present embodiment is a laser beam printer adopting an electrophotographic system. The printer 100 includes, as illustrated in FIG. 1, a cassette sheet feeding unit 60, an image forming unit 40, a fixing unit 12, a duplex conveyance unit 70 serving as a re-conveyance unit, and a control unit 90.

When an image forming command is output to the printer 100, an image forming process, i.e., image forming operation, by the image forming unit 40 is started based on an image information entered from an external computer etc. that is connected to the printer 100. The image forming unit 40 is equipped with four laser scanners 1Y, 1M, 1C, and 1K, and four process cartridges 50Y, 50M, 50C, and 50K for forming images of four colors, which are yellow (Y), magenta (M), cyan (C), and black (K). Further, the image forming unit 40 includes an intermediate transfer belt 7 serving as an image bearing member, primary transfer rollers 8Y, 8M, 8C, and 8K, a secondary transfer inner roller 41, and a secondary transfer outer roller 42. The four process cartridges 50Y, 50M, 50C, and 50K adopt the same configuration except for the difference in color of formed images, such that only the image forming process of process cartridge 50Y will be described and descriptions of process cartridges 50M, 50C, and 50K will be omitted.

The laser scanner 1Y irradiates laser light toward a photosensitive drum 2Y of the process cartridge 50Y based on the image information being entered. In this state, the photosensitive drum 2Y is charged in advance by a charge roller 3Y, and an electrostatic latent image is formed on the photosensitive drum 2Y by irradiating laser light thereon. Thereafter, the electrostatic latent image is developed by a developing sleeve 5Y of a developing apparatus 4Y, and a yellow (Y) toner image is formed on the photosensitive drum 2Y. Toner remaining on the photosensitive drum 2Y after the toner image has been transferred to the intermediate transfer belt 7 is collected by a cleaning blade 6.

Similarly, magenta (M), cyan (C), and black (K) toner images are also formed on respective photosensitive drums of process cartridges 50M, 50C, and 50K. The toner images of respective colors formed on the respective photosensitive drums are transferred to the intermediate transfer belt 7 via the primary transfer rollers 8Y, 8M, 8C, and 8K and conveyed to the secondary transfer inner roller 41 on the rotating intermediate transfer belt 7. The secondary transfer inner roller 41 forms a transfer nip N serving as a transfer unit together with the secondary transfer outer roller 42 with the intermediate transfer belt 7 interposed therein. The image forming processes of respective colors are performed at a timing such that the toner images are superposed to the toner image that has been primarily transferred upstream thereof on the intermediate transfer belt 7.

In parallel with the image forming process described above, a sheet P is fed from the cassette sheet feeding unit 60 or a sheet feed path 31. The cassette sheet feeding unit 60 includes a plurality of, which according to the present embodiment is four, cassettes 15*a*, 15*b*, 15*c*, and 15*d*. Sheets P are fed from the cassettes 15*a*, 15*b*, 15*c*, and 15*d* via pickup rollers 17*a*, 17*b*, 17*c*, and 17*d*, and are conveyed upward by conveyance roller pairs 20*a*, 20*b*, 20*c*, and 20*d*.

The sheet P fed from the cassette sheet feeding unit 60 or the sheet feed path 31 is conveyed to a conveyance path 32, and skewing of the sheet is corrected by a pre-registration roller pair 19 and a registration roller pair 18. Specifically, the sheet P is conveyed by the pre-registration roller pair 19 such that a leading edge of the sheet P is abutted against a nip portion of the registration roller pair 18 in a stopped state. The sheet P is further conveyed by the pre-registration roller pair 19 in a state where the leading edge of the sheet P is abutted against the nip portion of the registration roller pair 18, such that the leading edge of the sheet P is aligned on the nip portion and skewing of the sheet P is corrected.

Then, the sheet P is conveyed toward the transfer nip N by the registration roller pair 18 at a matched timing with the transfer timing of toner image at the transfer nip N. By having a predetermined electrostatic bias applied to the secondary transfer outer roller 42, the toner image borne on the intermediate transfer belt 7 is transferred to the sheet P at the transfer nip N. Residual toner remaining on the intermediate transfer belt 7 is collected by a cleaner 10. The secondary transfer outer roller 42 is abutted against the intermediate transfer belt 7 during transfer to the sheet P, but when transfer to the sheet P is completed, it is separated from the intermediate transfer belt 7.

The sheet P to which toner image has been transferred is conveyed by an air suction belt 43 to the fixing unit 12. The fixing unit 12 includes a hollow fixing roller 13 having a heater built therein, and a pressure roller 14 in pressure contact with the fixing roller 13. A predetermined pressurizing force and heat is applied to the sheet P at the fixing unit 12, and the toner image is thereby melted and fixed. The sheet P having passed through the fixing unit 12 is conveyed by post-fixing conveyance roller pairs 45 and 46 to a sheet discharge conveyance path 61 if the sheet is to be discharged onto a sheet discharge tray 24 without further processing, and to a reverse guidance path 62 if images are to be formed on both sies of the sheet P.

A guide member 63 capable of switching sheet conveyance paths is arranged pivotably at a branching portion between the sheet discharge conveyance path 61 and the reverse guidance path 62. The guide member 63 is designed to switch paths according to a sheet discharge mode in which the sheet P is discharged to the sheet discharge tray 24, a reverse discharge mode in which the sheet P is reversed before being discharged, and a duplex printing mode in which the sheet P is conveyed again to the image forming unit 40 to be subjected to duplex printing. Then, by switching conveyance paths by the guide member 63, the sheet P is guided to the sheet discharge conveyance path 61 or the reverse guidance path 62 depending on the mode being set.

For example, in the case of the sheet discharge mode, the guide member 63 pivots downward and moves to a discharge position for discharging sheets. Thereby, the sheet P conveyed by the post-fixing conveyance roller pairs 45 and 46 is conveyed along the upper surface of the guide member 63 to the sheet discharge conveyance path 61, and discharged by a sheet discharge roller pair 21*a* to the sheet discharge tray 24.

In the duplex printing mode, the sheet P has its front and rear sides reversed by the duplex conveyance unit 70 before being conveyed again to the transfer nip N. The duplex conveyance unit 70 incudes the reverse guidance path 62, a switchback path 64 for reversing front and rear sides of the sheet P having passed through the fixing unit 12, and a duplex conveyance path 65 for conveying the sheet P from the switchback path 64 toward the transfer nip N. Further, the duplex conveyance unit 70 includes reverse conveyance roller pairs 22*a* and 22*b* for conveying the sheet P on the switchback path 64 serving as a reverse conveyance path, and conveyance roller pairs 23*a*, 23*b*, 23*c*, and 23*d* for conveying the sheet P on the duplex conveyance path 65 serving as a re-conveyance path.

In the duplex printing mode, the guide member 63 pivots upward and moves to a drawing position for guiding the sheet to the reverse guidance path 62. Thereby, the sheet P conveyed by the post-fixing conveyance roller pairs 45 and 46 is guided along the lower surface of the guide member 63 to the reverse guidance path 62 and drawn into the switchback path 64 by the reverse conveyance roller pair 22*a*. Then, the leading and trailing edges and front and rear sides of the sheet P are switched by a switchback operation in which the reverse conveyance roller pair 22*b* arranged on the switchback path 64 is rotated in normal and reverse directions, before the sheet P is conveyed to the duplex conveyance path 65. Such a process is also referred to as a duplex printing process.

Then, the sheet P is merged with the conveyance path 32 again by the conveyance roller pairs 23*a*, 23*b*, 23*c*, and 23*d* and sent to the transfer nip N. The image forming process subsequently performed to a rear surface, i.e., second surface, is similar to the image forming process performed to the front surface, i.e., first surface, described above.

Furthermore, similarly according to the reverse discharge mode, the guide member 63 pivots upward and moves to the drawing position. Thereby, the sheet P is conveyed to the reverse guidance path 62 by the post-fixing conveyance roller pairs 45 and 46 and drawn into the switchback path 64 by the reverse conveyance roller pair 22*a*. Thereafter, leading and trailing edges of the sheet P are switched by a switchback operation in which the reverse conveyance roller pair 22*a* is rotated in normal and reverse directions, and the sheet P is conveyed to a reverse discharge path 66. Thereafter, the sheet P is conveyed to the sheet discharge roller pair 21*a* by a reverse conveyance roller pair 21*b* provided on the reverse discharge path 66 and discharged by the sheet discharge roller pair 21*a* to the sheet discharge tray 24. Such a process is also referred to as a reverse discharge processing.

According to the present embodiment, a configuration is taken as an example in which the sheet P is discharged to the exterior of the printer 100 by the sheet discharge roller pair 21*a* and supported on the sheet discharge tray 24, but the present embodiment is not limited to this configuration. For example, a different device such as a finisher can be connected to the printer 100, and the sheet P can be transferred to the other device by the sheet discharge roller pair 21*a*. The finisher connected to the printer 100 can perform a punching process in which holes are punched to the sheet P, a saddle stitching process in which a center portion of a plurality of sheets is stitched by a wire or a stapler, or a case binding process in which a back surface of the plurality of sheets being bound is fixed to a cover with an adhesive.

Control Unit

Figure 2A:
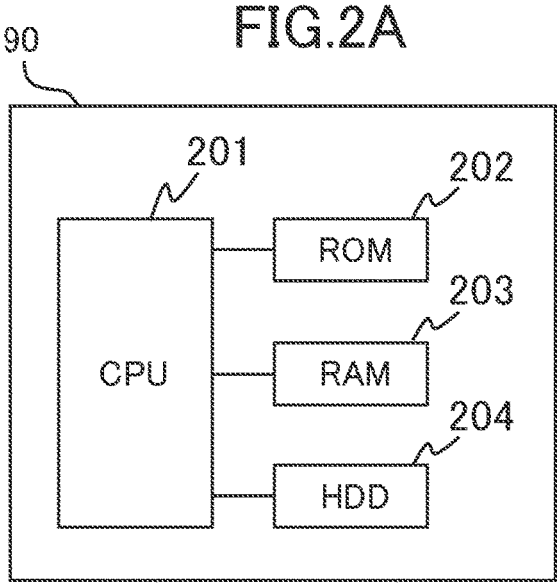
FIG. 2A is a block diagram illustrating a hardware configuration of a control unit.
Figure 2B:
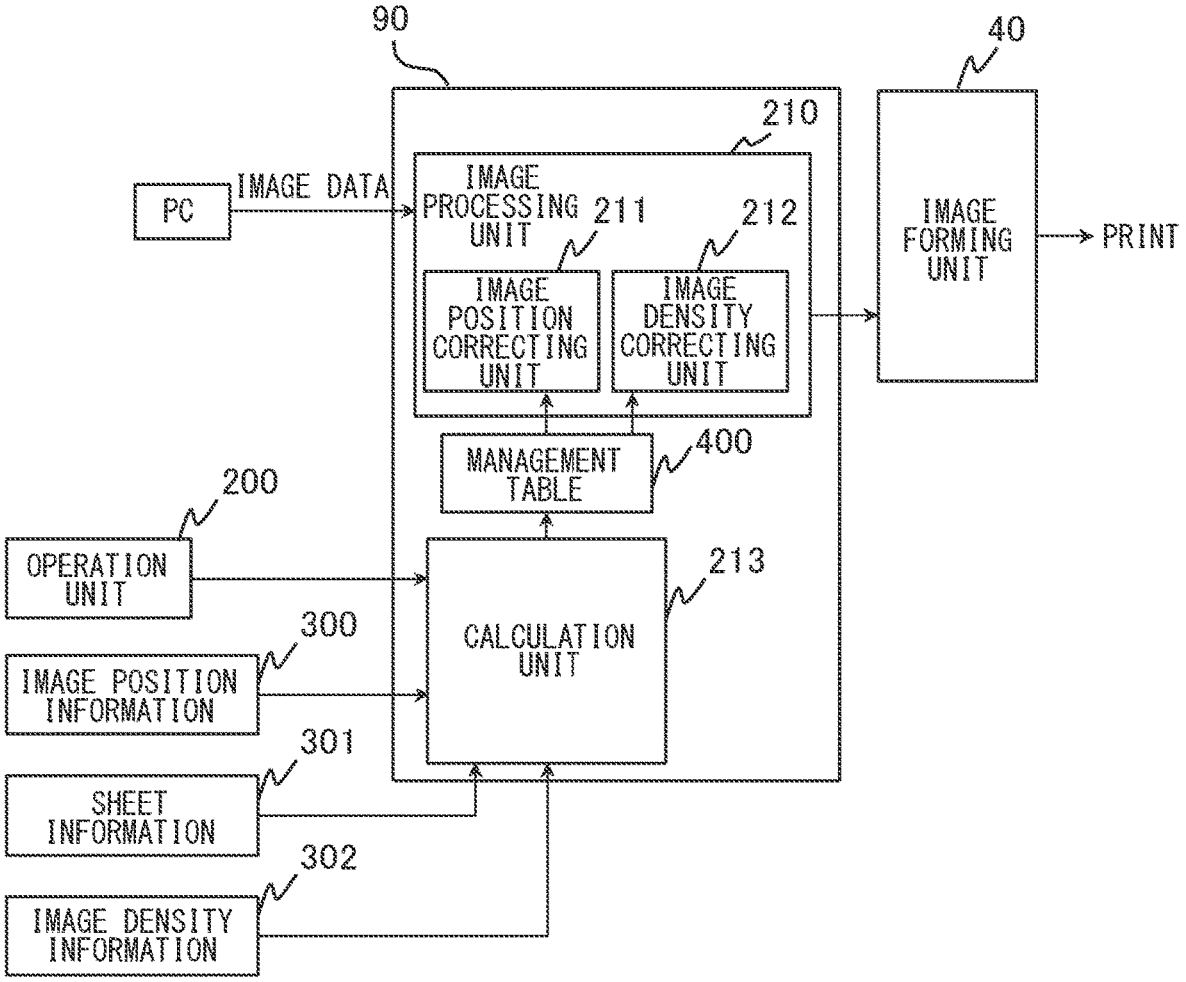
FIG. 2B is a block diagram illustrating a functional configuration of the control unit.

Next, a configuration of the control unit 90 of the printer 100 will be described with reference to FIGS. 2A and 2B. FIG. 2A is a block diagram illustrating a hardware configuration of the control unit 90. FIG. 2B is a block diagram illustrating a functional configuration of the control unit 90.

As illustrated in FIG. 2A, the control unit 90 includes a CPU (Central Processing Unit) 201, a ROM (Read Only Memory) 202, and a RAM (Random Access Memory) 203. Further, the control unit 90 includes an HDD (Hard Disc Drive) 204. The CPU 201 is a control unit configured to control the respective units. The ROM 202 stores a control program executed by the CPU 201. The RAM 203 is a system work memory that enables the CPU 201 to operate. The HDD 204 stores an image data transferred from the PC or setting information and the like entered from an operation unit 200.

As illustrated in FIG. 2B, the control unit 90 includes an image processing unit 210, a management table 400, and a calculation unit 213, wherein the image processing unit 210 includes an image position correcting unit 211, and an image density correcting unit 212.

A setting information of the operation unit 200, an image position information 300, a sheet information 301, and an image density information 302 are entered to the calculation unit 213. Information such as the image position information 300, the sheet information 301 and the image density information 302 are information acquired from various measurement units provided within the printer 100.

The operation unit 200 is one example of a user interface unit. The operation unit 200 includes a display unit, and a key entry unit. The operation unit 200 has a function to receive the setting information and the like entered by the user via the display unit and the key entry unit. Further, the operation unit 200 has a function to provide information to the user via the display unit. The key entry unit includes, for example, a start key for instructing start of execution of scanning and copying operations, a stop key for instructing interruption of the scanning and copying operations, and a numeric keypad.

The image position information 300 is information related to the position of image transferred and fixed to the sheet, and for example, it is detected by a sensor such as a CIS (Contact Image Sensor) or a CCD (Charge Coupled Device). The sheet information 301 is information related to the sheet itself, and for example, the information relates to a position of an edge portion of a sheet being conveyed, which is detected by a scanner sensor such as the CIS or the CCD, or by a transmission-type or regression reflection-type photoelectric sensor. Further, the sheet information 301 is information regarding sheet size, for example, and the sheet size can be measured or calculated by using one sensor or a plurality of sensors for detecting the position of the edge portion of the sheet.

The image density information 302 is information related to the density of the image transferred and fixed to the sheet, and for example, it is detected by a color sensor equipped with a line sensor that disperses reflected light from a white LED and detects the light resolved per wavelength. According to the present embodiment, at least one of the respective measurement units is provided immediately after the fixing unit 12, that is, downstream of the fixing unit 12 in a sheet conveyance direction CD, and sets the same as a sensor 30. That is, the sensor 30 serving as a detection unit detects the information of the sheet being conveyed.

The calculation unit 213 acquires an amount of deviation of image information and an amount of deviation of image density based on the information acquired from the sensor 30. The amount of deviation of image position and the amount of deviation of image density acquired by the calculation unit 213 are stored in the management table 400, and a conversion formula for correcting the amount of deviation of image position and the amount of deviation of image density per sheet are stored in the management table 400.

Correction Control by Image Processing Unit

Figure 3:
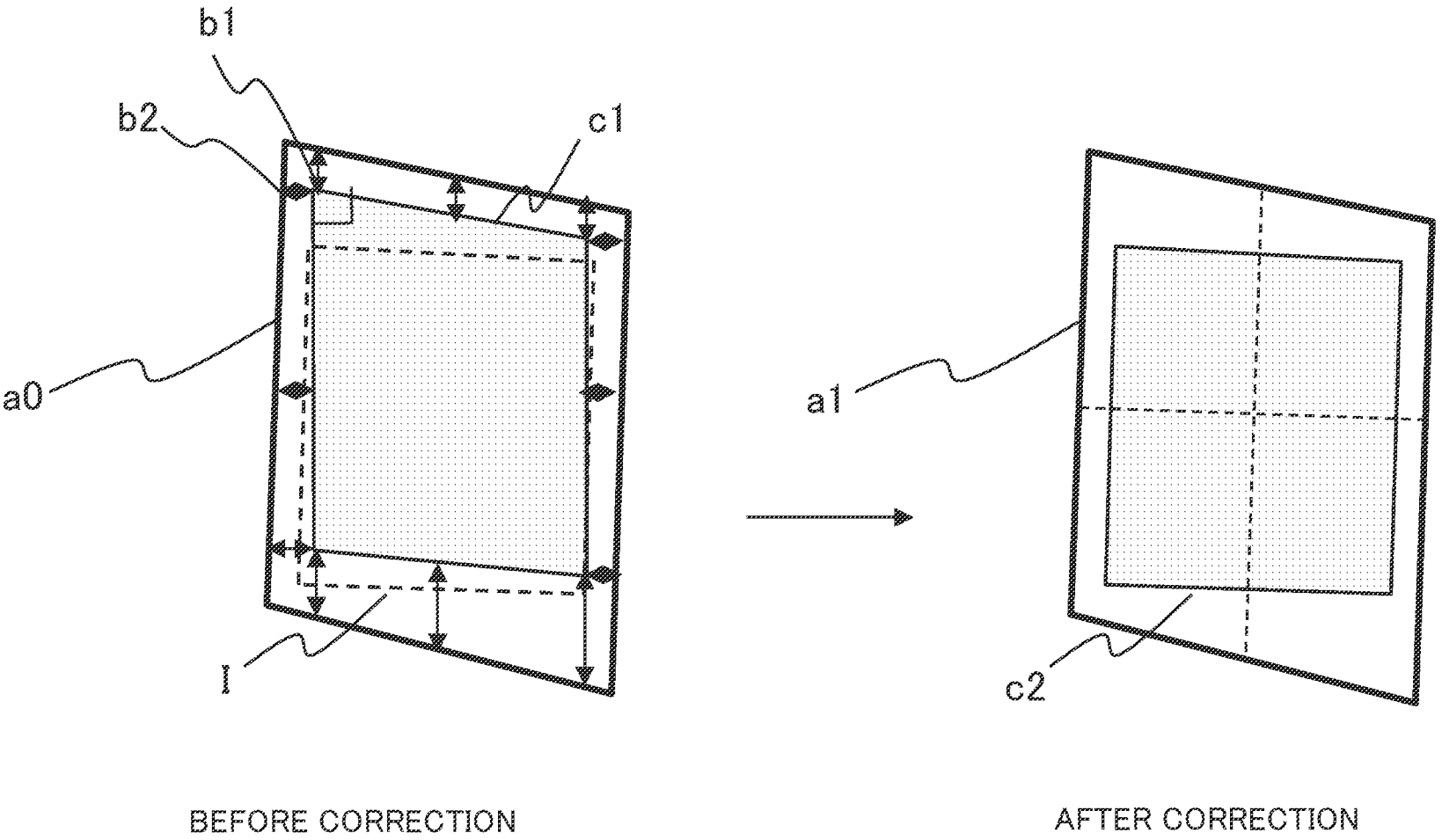
FIG. 3 is a view illustrating an image position before performing image position correction control and the image position after performing image position correction control.

Next, correction control by the image processing unit 210 will be described. More specifically, image position correction control by the image position correcting unit 211 and image density correction control by the image density correcting unit 212 will be described in detail. FIG. 3 is a view illustrating an image position before performing image position correction control and image position after performing image position correction control.

The image position correcting unit 211 is capable of executing image position correction control for correcting image data such that a position of the image with respect to the sheet is at a target position. The image position of the image formed on the sheet by the image forming operation may not be positioned at the ideal image position. For example, as illustrated in FIG. 3, an image c1 is formed on a sheet a0 at a position deviated from an ideal position I illustrated by a broken line.

For example, in a case where a sheet conveyed by the registration roller pair 18 is inclined, the obliquely inclined sheet passes through the transfer nip N, such that the image formed on the sheet is also inclined with respect to the sheet. Further, for example, if a pressure distribution of roller of the fixing unit 12 is not uniform, the sheet may be deformed after passing through the fixing unit 12, such that the image formed on the sheet may also be inclined with respect to the sheet. Further, for example, in duplex printing, when an image is formed on the first side of the sheet, the heat and pressure applied in the fixing unit 12 may cause expansion or contraction of the sheet, such that the size of the image formed on the first surface of the sheet and the size of the image formed on the second surface of the sheet may differ. In that case, the image position of the image formed on the first surface of the sheet and the image position of the image formed on the second surface of the sheet may differ.

Therefore, in the image forming operation, the image position correcting unit 211 corrects a shape of the image to be formed on the photosensitive drums 2Y, 2M, 2C, and 2K such that an image c2 is formed at an ideal position with respect to a succeeding sheet a1 based on the position of the image c1 on the sheet a0. More specifically, the sensor 30 includes an image position detecting sensor configured to detect distances b1 and b2 from an edge portion of the sheet to the image c1. The calculation unit 213 calculates an amount of deviation from the ideal position I to the image c1 based on the detection result of the image position detecting sensor. Then, the image position correcting unit 211 corrects the shape of the image to be formed on the photosensitive drums 2Y, 2M, 2C, and 2K according to the amount of deviation calculated by the calculation unit 213 such that the image position of the image c2 is positioned at the ideal position on the sheet a1.

In this state, the image position correcting unit 211 converts an image data based on the conversion formula for correcting the deviation of the image position on the sheet stored in the management table 400. If the image forming unit 40 forms the image based on the image data converted by the image position correcting unit 211, an image that cancels the deviation of the image position on the sheet is formed on the intermediate transfer belt 7. The distance (b1, b2) detected by the sensor 30 should be measured at least at one of the arrows illustrated in FIG. 3.

Further, the image density correcting unit 212 is capable of executing an image density correction control for correcting the image data such that a density of the image transferred and fixed to the sheet is a target density. The image density of the image being transferred and fixed to the sheet may not be the ideal density. For example, the humidity within the apparatus may vary according to the environment in which the printer 100 is installed or the rising of temperature within the printer 100 by operation. Therefore, when forming electrostatic latent images on the photosensitive drums 2Y, 2M, 2C, and 2K, or when forming visible images using toner by the developing apparatuses 4Y, 4M, 4C, and 4K, the density may be deviated from the target density.

Therefore, in the image forming operation, the image density correcting unit 212 changes the target density of the image to be formed on the photosensitive drums 2Y, 2M, 2C, and 2K according to the amount of deviation such that the density of the image on the sheet becomes an ideal density. In further detail, the sensor 30 includes an image density detecting sensor that detects a density of the toner image formed on the sheet. The calculation unit 213 calculates an amount of deviation between the ideal density and the density of the image c1 based on the detection result of the image density detecting sensor.

Further, the image density correcting unit 212 converts the image data based on the conversion formula for correcting the deviation of image density on the sheet stored in the management table 400. If the image forming unit 40 forms the image based on the image data converted by the image density correcting unit 212, an image that cancels the deviation of density of the image on the sheet is formed on the intermediate transfer belt 7.

Image Position Correction Control of Booklet

Figure 4B:
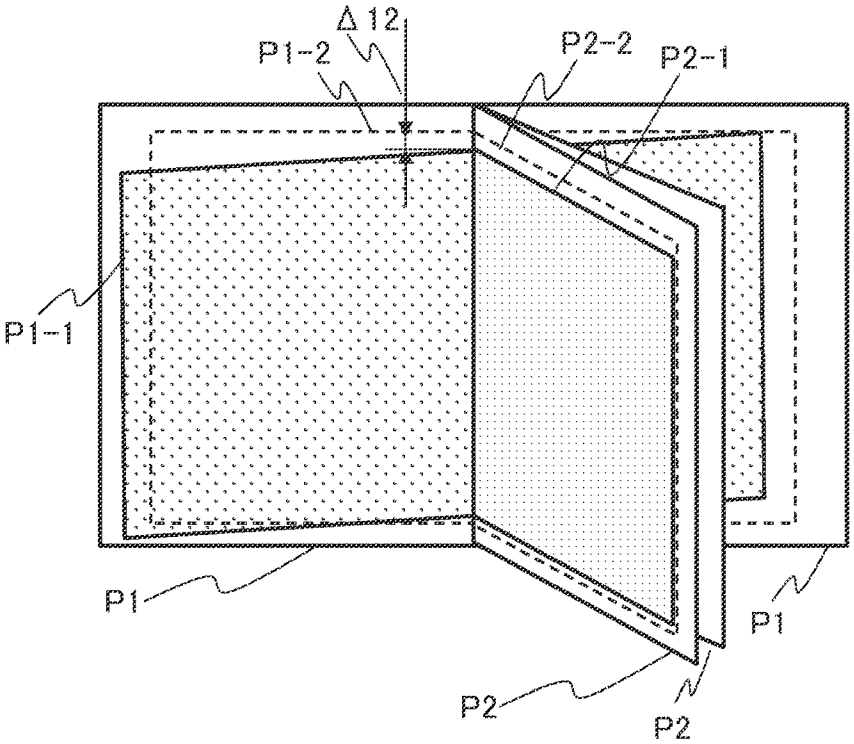
FIG. 4B is a perspective view illustrating a state in which an image subjected to correction is printed on a second sheet of the booklet.
Figure 4A:
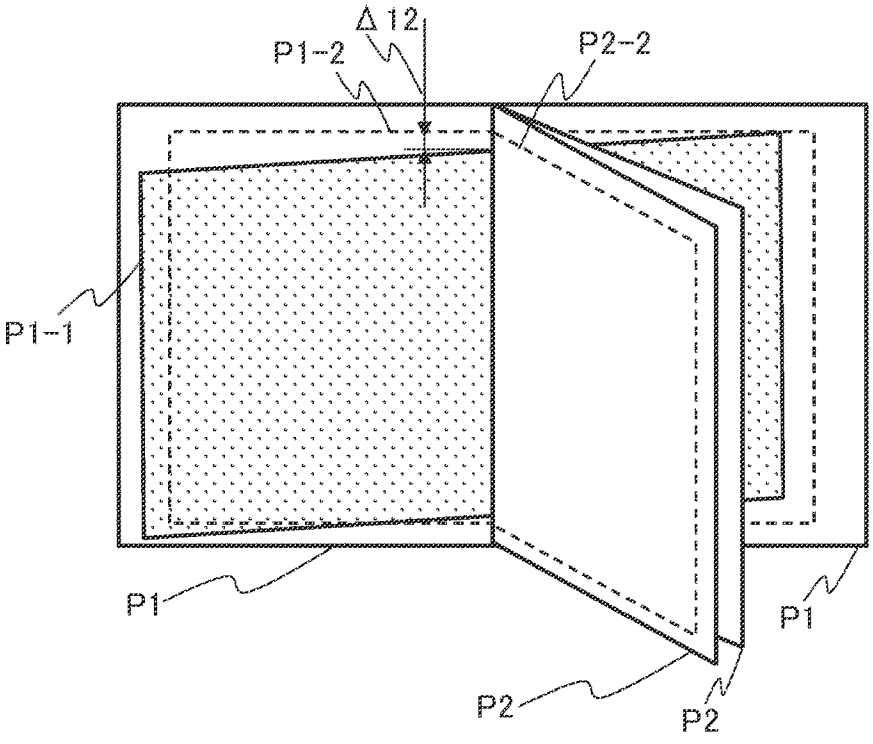
FIG. 4A is a perspective view illustrating a state in which an image is printed on a first sheet of a booklet.

Next, an image position correction control of a booklet mode that is executed when forming a booklet will be described with reference to FIGS. 4A and 4B. FIG. 4A is a perspective view illustrating a state in which an image is formed, hereinafter sometimes simply described as printed, on a first sheet of the booklet. FIG. 4B is a perspective view illustrating a state in which an image having been corrected by the image position correcting unit 211 is transferred to a second sheet of the booklet.

As illustrated in FIG. 4A, an image P1-1 is formed at a position deviated from an ideal position P1-2 illustrated by the broken line on a first sheet P1 of the booklet. The amount of deviation of the image P1-1 from the ideal position P1-2 is an amount of deviation 412. The calculation unit 213 computes the amount of deviation 412 based on a distance from the sheet edge portion to the image P1-1 detected by the sensor 30.

In the case of a booklet, in a case where the image P1-1 formed on the first sheet P1 is deviated from the ideal position P1-2, if an image is formed on an ideal position P2-2 on the second sheet P2, the images formed on adjacent sheets P1 and P2 will be deviated. Therefore, by correcting the position of the image P2-1 to be formed on the second sheet P2 according to the position of the image P1-1 formed on the first sheet P1, a high-quality product can be obtained. The product includes sheets having been subjected to post-processing, such as folding and bookbinding.

According to the present embodiment, the image P2-1 to be formed on the sheet P2 adjacent to the sheet P1 is corrected based on the amount of deviation 412 such that it is shifted from the ideal position P2-2 before being formed on the intermediate transfer belt 7. That is, the control unit 90 corrects the position of the image P2-1 of the sheet P2 being formed on the intermediate transfer belt 7. Thereby, the image P2-1 being transferred to the sheet P2 will have less relative positional deviation from the image P1-1 formed on the adjacent sheet, or sheet P1, and a high-quality product can thereby be obtained.

In image density correction control of a booklet, the control unit 90 corrects the density of the image P2-1 for the sheet P2 being formed on the intermediate transfer belt 7 based on the density of the image P1-1 formed on the first sheet P1. Thereby, the image P2-1 being transferred to the sheet P2 will have less relative density deviation from the image P1-1 formed on the adjacent sheet, or sheet P1, and a high-quality product can thereby be obtained.

Duplex Printing Circulation Operation

Figure 5:
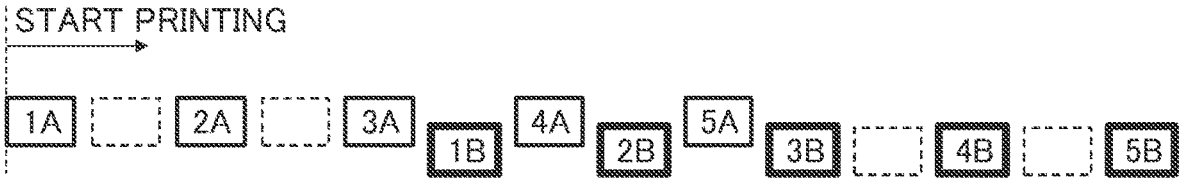
FIG. 5 is a view illustrating an order in which an image forming operation is performed.

Next, a circulation operation of a sheet when performing normal duplex printing will be described with reference to FIG. 5. FIG. 5 is a view illustrating an order in which the image forming operation is performed, and it shows that images are transferred to the sheets in the order in which the sheets are illustrated from left to right in the drawing along with the elapse of time. Normal duplex printing is performed when a bookbinding process such as a saddle stitch bookbinding is not performed.

Further, the reference numbers such as "1A" and "3B" in FIG. 5 denotes the order in which the sheet has been conveyed by the numeric value and the surface of the sheet by the alphabet. The alphabet "A" refers to the surface on which the image is transferred before the sheet is reversed, and "B" refers to the surface on which the image is transferred after the sheet has been reversed. For example, "3A" denotes the front surface of the third sheet being fed and "1B" denotes the rear surface of the first sheet being fed.

As illustrated in FIG. 5, when performing duplex printing to five sheets, the printer 100 forms images to the front surface of three sheets, 1A to 3A, in the named order, and thereafter, forms an image to the rear surface, 1B, of the first sheet. Then, the printer 100 forms images alternately to the front surface and the rear surface of sheets in the named order of 1B, 4A, 2B, and 5A, and thereafter, forms images successively to the rear surfaces of the last three sheets, 3B to 5B, to thereby end the duplex printing of five sheets. If six or more sheets are subjected to duplex printing, the period of time during which printing is performed alternately to the front surface and the rear surface of the sheets is extended.

Printing Order of Bookbinding According to Reference Example

Figure 6A:
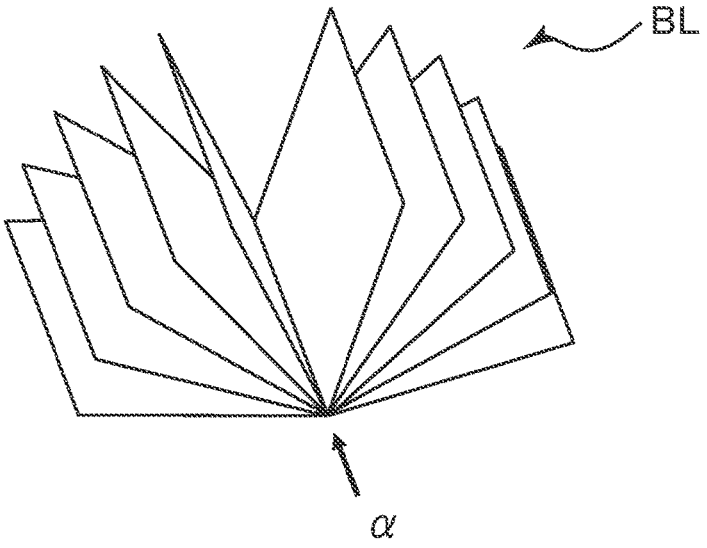
FIG. 6A is a perspective view illustrating a booklet formed by saddle stitch bookbinding.

Next, the printing order of bookbinding according to a reference example will be described with reference to FIGS. 6A to 8. FIG. 6A is a perspective view illustrating a booklet subjected to saddle stitch bookbinding, and FIG. 6B is a view of the booklet viewed in an arrow α direction.

Figure 6B:
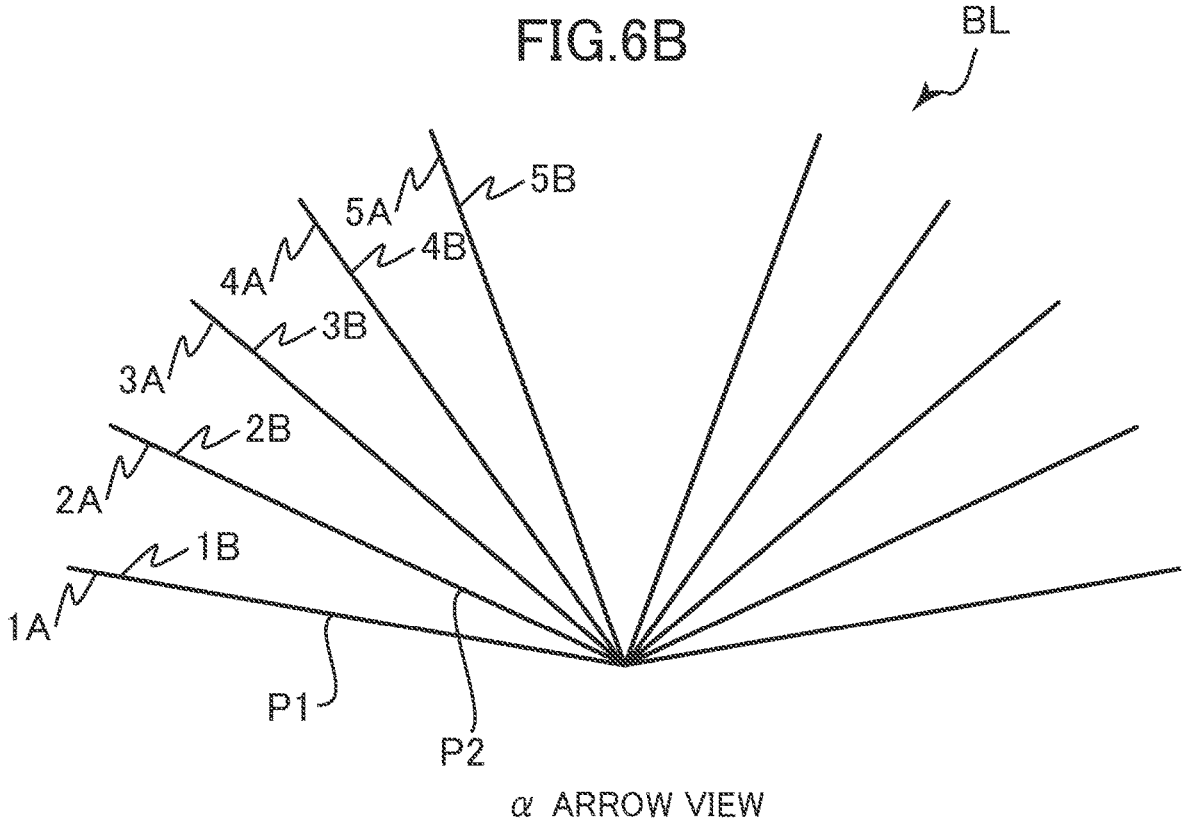
FIG. 6B is a view illustrating the booklet in a view taken in the direction of arrow a of FIG. 6A.

As illustrated in FIGS. 6A and 6B, when performing saddle stitch bookbinding, a plurality of A3 size sheets, for example, are subjected to duplex printing and stacked. Then, center portions of the stacked sheets are folded in half such that the fold projects downward, and the center portion is bound by stapling or the like, i.e., binding process, by which the sheets are subjected to saddle stitch bookbinding. Further, the stacking of sheets having been subjected to duplex printing and the binding process thereof are performed in a finisher connected to the printer 100 according to the present embodiment, but they can also be performed within the printer 100.

According to such a saddle stitch bookbinding process, the first sheet having been printed first is discharged to the exterior of the apparatus with the lower surface denoted as "1A" and the upper surface denoted as "1B". Then, as illustrated in FIG. 6B, in a case where five sheets are subjected to duplex printing, sheets are stacked in a state where a lowermost surface is "1A" and an uppermost surface is "5B". In this case, in the state of a booklet formed by saddle stitch bookbinding, each set of surfaces of sheets that are arranged adjacent to one another are "1B" and "2A", "2B" and "3A", "3B" and "4A", and "4B" and "5A".

Figure 7:
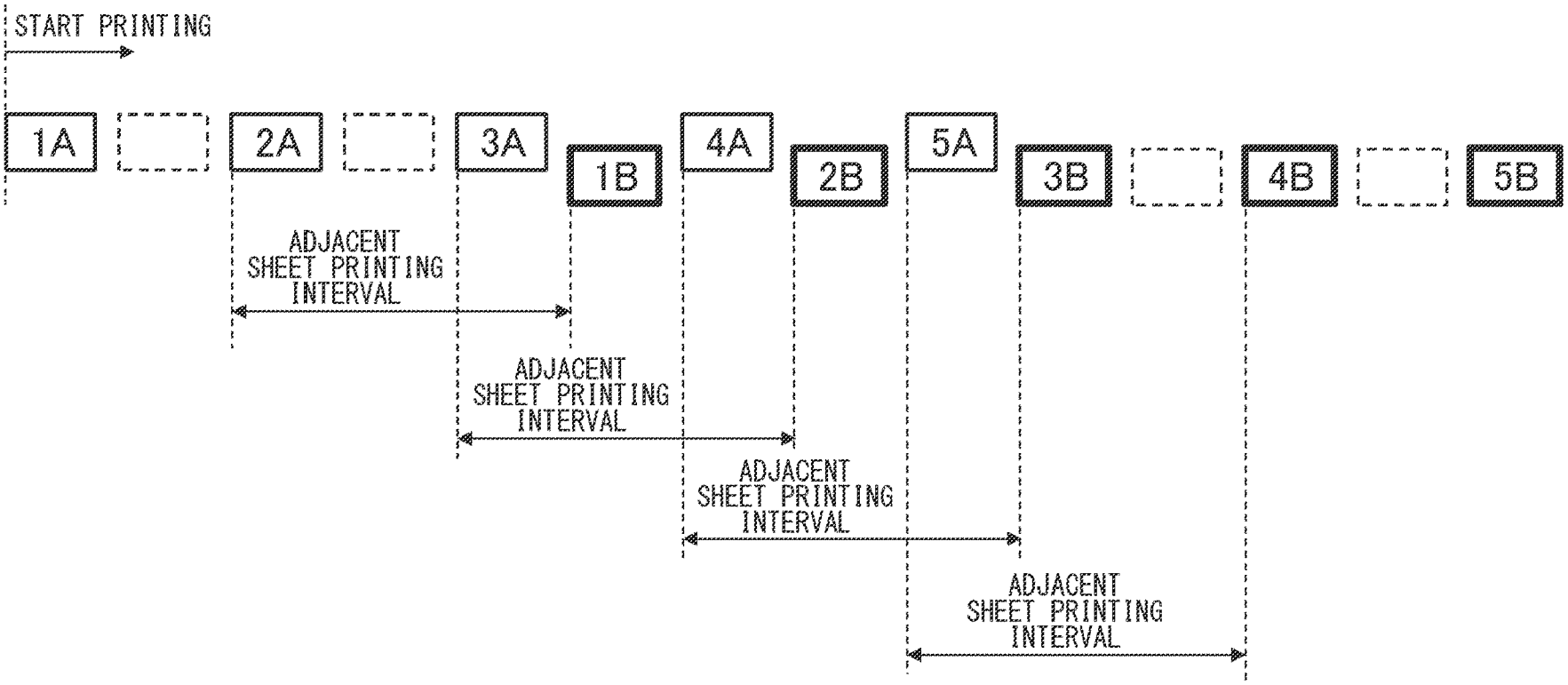
FIG. 7 is a view illustrating an image forming order in which images are formed to five sheets according to a reference example.

FIG. 7 is a view illustrating an image forming order in which images are formed to five sheets by duplex printing. A printing interval between sheets which are to be arranged adjacent to one another in the booklet state, that is, the number of pages being printed to other surfaces, or pages, between the printing of two adjacent surfaces, is referred to as an adjacent sheet printing interval. As illustrated in FIG. 7, the sets of adjacent surfaces are "1B" and "2A", "2B" and "3A", "3B" and "4A", and "4B" and "5A", such that the adjacent sheet printing interval is two sheets. For example, printing of two pages, "1B" and "4A", are performed between the printing of "2B" and "3A", such that the adjacent sheet printing interval is two sheets. Further, the rectangles shown by the broken line of FIG. 7 virtually denote an interval of one sheet, and for example, there are no sheets to be conveyed between "1A" and "2A", but a sheet interval corresponding to one sheet is ensured.

Figure 8:
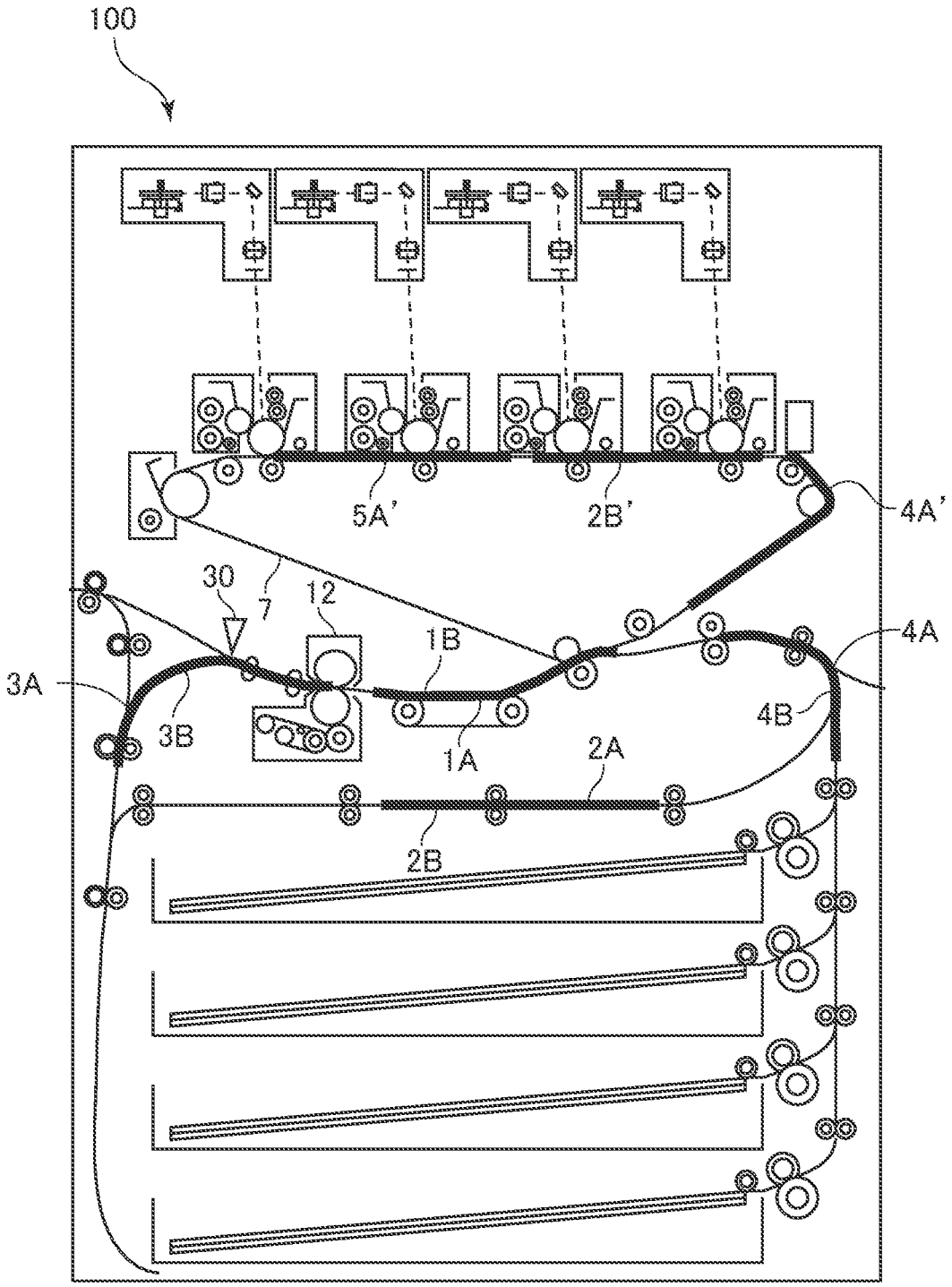
FIG. 8 is a view illustrating a state of sheets circulated in the printer and images on an intermediate transfer belt according to the reference example.

FIG. 8 is a view illustrating a timing at which "3A", i.e., front surface of the third sheet, has passed through the fixing unit 12. In this state, as illustrated in FIG. 8, an image "4A'" to be transferred to "4A", an image "2B'" to be transferred to "2B", and image "5A'" to be transferred to "5A" are borne on the intermediate transfer belt 7. The adjacent surface that forms a pair with "3A" is "2B", but as illustrated in FIG. 8, the image "2B'" to be transferred to "2B" is already formed on the intermediate transfer belt 7 at a point of time when "3A" is passed through the fixing unit 12. Therefore, the image "2B'" cannot be corrected based on the deviation of image position after detecting the deviation of image position on "3A" by the sensor 30.

As described, according to the printing order during bookbinding according to the reference example described with reference to FIGS. 6A to 8, the adjacent sheet printing interval is two sheets, such that there is a drawback in that the printing interval between sheets is too short to perform feedback of the detection result of the sensor 30 and use the result to correct the image to be printed to an adjacent surface.

Printing Order During Bookbinding According to Present Embodiment

Figure 9:
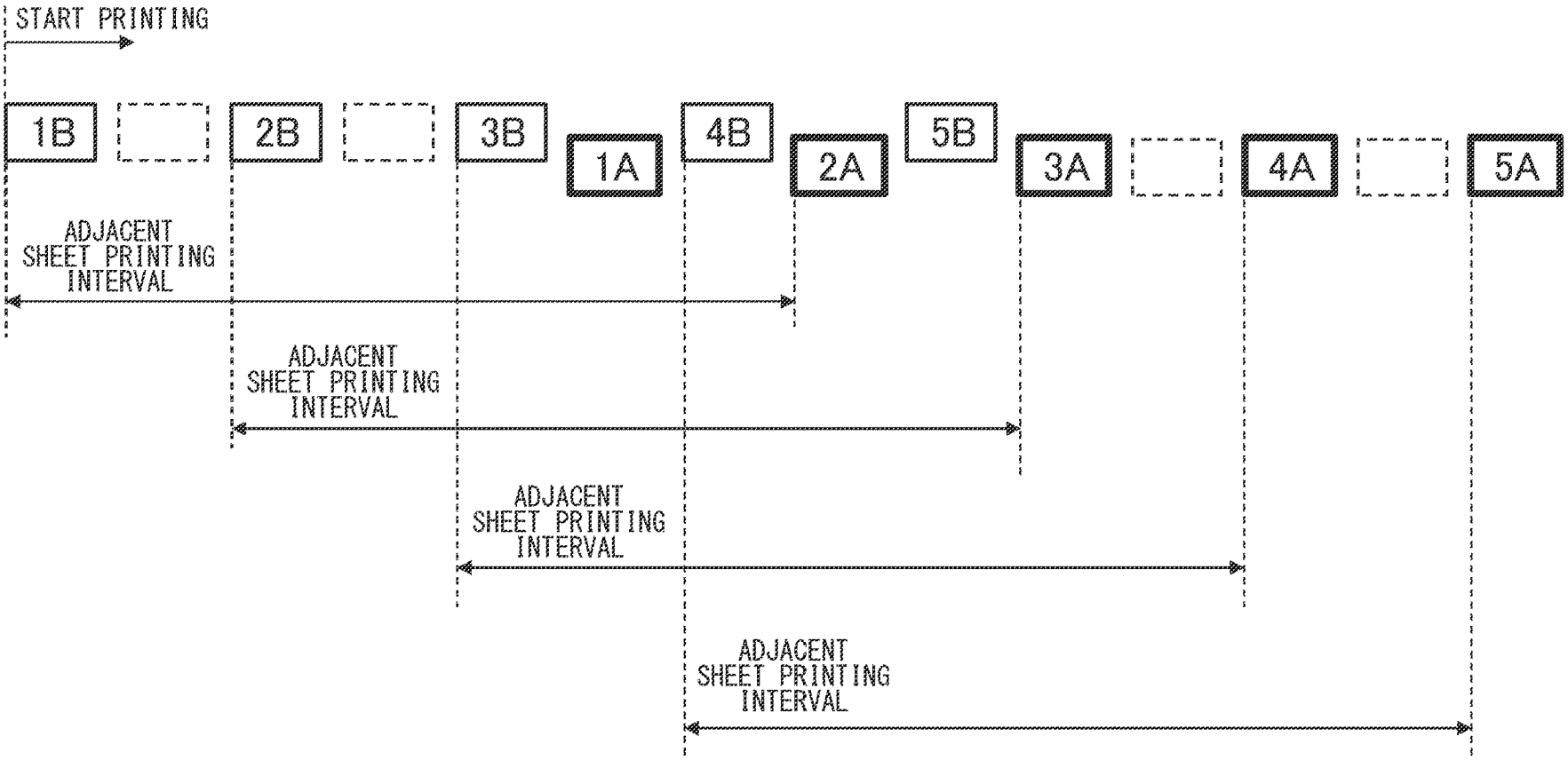
FIG. 9 is a view illustrating an image forming order in which images are formed to five sheets according to the present embodiment.
Figure 10:
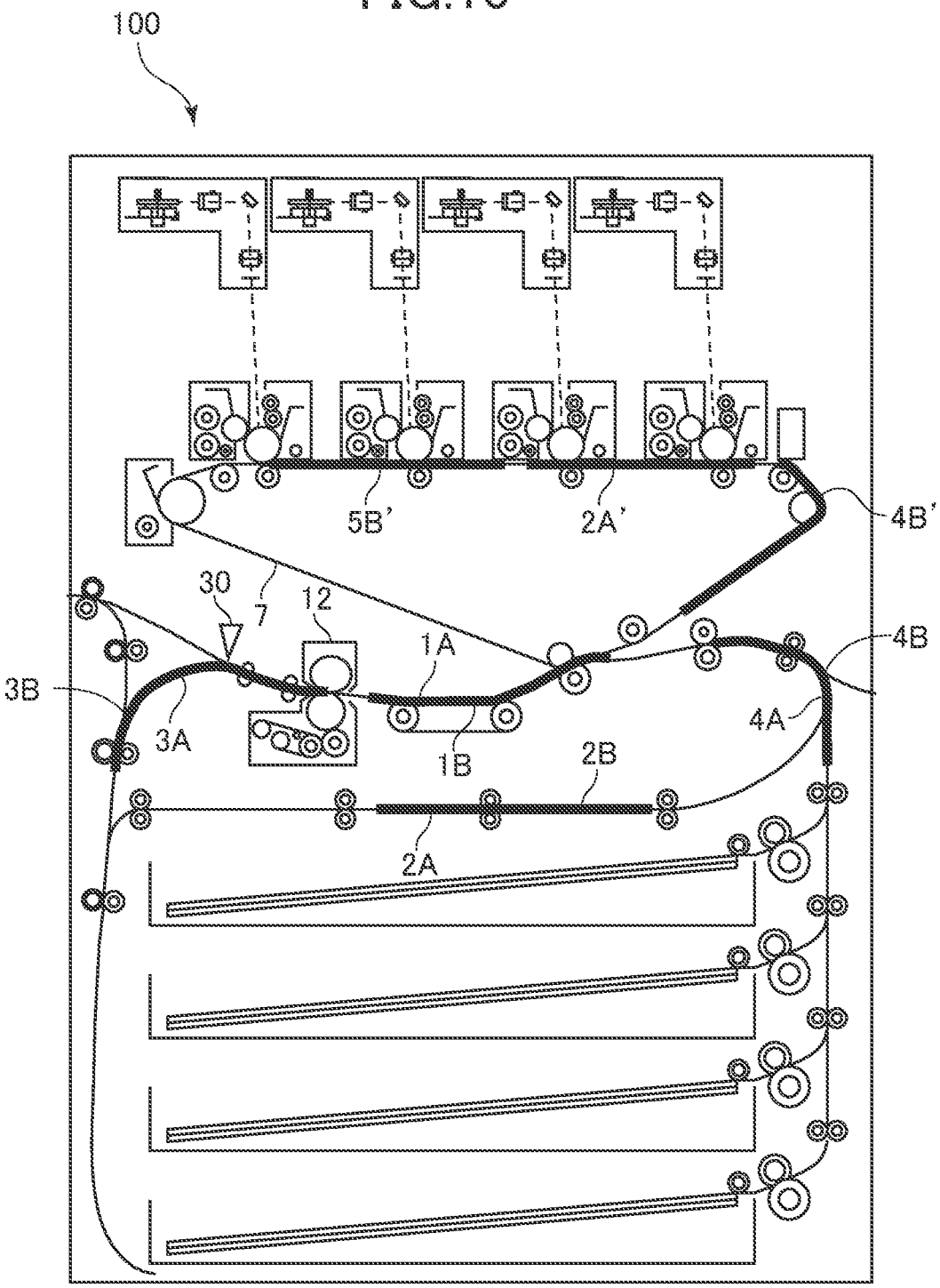
FIG. 10 is a view illustrating a state of sheets circulated in the printer and images on the intermediate transfer belt according to the present embodiment.

Next, a printing order during bookbinding according to the present embodiment will be described with reference to FIGS. 9 and 10. FIG. 9 is a view illustrating an image forming order of forming images to five sheets subjected to duplex printing according to the present embodiment. FIG. 10 is a view illustrating a state of the sheets circulated within the printer 100 and the images on the intermediate transfer belt 7. In the present embodiment, a printing mode for creating a booklet by saddle stitch bookbinding is referred to as a booklet mode. In the following, the operation of the booklet mode will be described.

As illustrated in FIG. 9, according to the present embodiment, printing is performed to five sheets to be subjected to saddle stitch bookbinding in the named order of "1B", "2B", "3B", "1A", "4B", "2A", "5B", "3A", "4A", and "5A". In the description, surface "A" is a surface that is arranged as a lower surface when being discharged and stacked, and it is a surface on which image is transferred after the sheet has been reversed. Surface "B" is a surface that is arranged as an upper surface when being discharged and stacked, and it is a surface on which image is transferred before the sheet is reversed.

Specifically, when performing duplex printing to five sheets to be subjected to saddle stitch bookbinding, the printer 100 forms images to the upper surface of three sheets, 1B to 3B, in the named order, and thereafter, forms an image to a rear surface, 1A, of the first sheet. Then, the printer 100 forms images alternately to the front surface and the rear surface of sheets of 1A, 4B, 2A, and 5B in the named order, and thereafter, forming images successively to the rear surfaces of the last three sheets, 3A to 5A, by which the duplex printing of five sheets is ended. If six or more sheets are subjected to duplex printing, the period of time during which printing is performed alternately to the front surface and the rear surface of the sheets is extended.

Further, for example, the first sheet subjected to duplex printing passes through the fixing unit 12 in a state where the lower surface is "1B" and the upper surface is "1A". Therefore, in the booklet mode, the sheet having passed through the fixing unit 12 can be subjected to a reverse discharge processing such that the sheet is discharged to the exterior of the apparatus with the lower surface as "1A" and the upper surface as "1B". That is, the first sheet subjected to duplex printing is drawn into the reverse guidance path 62 and the switchback path 64. Then, the leading and trailing edges of the sheet are switched by a switchback operation in which the reverse conveyance roller pair 22*a* is rotated in normal and reverse directions, and the sheet is conveyed to the reverse discharge path 66. Thereafter, the sheet is conveyed by the reverse conveyance roller pair 21*b* provided on the reverse discharge path 66 to the sheet discharge roller pair 21*a*, and discharged to the exterior of the apparatus by the sheet discharge roller pair 21*a*. Such a reverse discharge processing can be performed to all the sheets subjected to saddle stitch bookbinding.

As described, according to the present embodiment, "1B" is printed first, unlike the case illustrated in FIG. 7 where "1A" is printed first. Then, after the sheet has been reversed, printing to "1A" is performed. That is, as illustrated in FIG. 6B, if the first sheet of the booklet BL is referred to as a sheet P1 serving as the first sheet, and if the second sheet of the booklet is referred to as a sheet P2 serving as the second sheet, the booklet BL includes the sheets P1 and P2. Further, the sheet P1 has a first surface 1A and a second surface 1B that is opposite to the first surface. The sheet P2 has a third surface 2A arranged adjacent to the second surface 1B of the sheet P1. In the present embodiment, the second surface 1B is a surface that faces upward when being discharged to the exterior of the apparatus, and the first surface 1A and the third surface 2A are surfaces that face down when being discharged to the exterior of the apparatus.

In the booklet mode of the present embodiment, the control unit 90 controls the image forming unit 40 such that the toner image is transferred to the second surface 1B of the sheet P1 before being transferred to the first surface 1A. Further, the control unit 90 controls the image forming unit 40 such that the toner image to be formed to the third surface 2A is corrected based on the information of the second surface 1B on the third surface 2A of the sheet P2 detected by the sensor 30. Specifically, the position and the density of the toner image to be formed on the third surface 2A is corrected.

The sets of adjacent surfaces are "1B" and "2A", "2B" and "3A", "3B" and "4A", and "4B" and "5A", such that as illustrated in FIG. 9, the adjacent sheet printing interval is six sheets. For example, an interval corresponding to six pages, which are a "broken line rectangle" corresponding to a sheet interval of one page, "3B", "1A", "4B", "2A", and "5B" exists between "2B" and "3A", such that the adjacent sheet printing interval is six sheets.

FIG. 10 is a view illustrating a timing at which "3B", i.e., the front surface of the third sheet, has passed through the fixing unit 12. In this state, as illustrated in FIG. 10, an image "4B'" to be transferred to "4B", an image "2A'" to be transferred to "2A", and an image "5B'" to be transferred to "5B" are borne on the intermediate transfer belt 7. The adjacent surface that forms a pair with "3B" is "4A", but the image "4A'" to be transferred to "4A" is not yet formed on the intermediate transfer belt 7. In other words, the toner image to be formed on an adjacent surface, i.e., 4A, of the successive sheet, i.e., second sheet, is not yet formed on the intermediate transfer belt 7 when the sheet, i.e., first sheet, on which is formed the toner image to be formed on the adjacent surface, i.e., 3B, passes through the sensor 30.

The printer 100 according to the present embodiment also forms images on sheets in the image forming order as described with reference to FIGS. 7 and 8 in a normal duplex printing mode in which images are formed on both surfaces of a plurality of sheets that do not constitute a booklet. For example, a duplex printing job is considered in which printing is performed to a plurality of sheets including a third sheet having a fourth surface and a fifth surface opposite to the fourth surface and a fourth sheet including a sixth surface to be arranged adjacent to a fifth surface of the third sheet when stacked on the third sheet, wherein the fourth sheet is conveyed subsequently to the third sheet. In this state, the period of time from printing the fifth surface to printing the sixth surface, that is, the adjacent sheet printing interval of the duplex printing mode as a second period of time, is two sheets, as mentioned above.

Meanwhile, in the booklet mode, the period of time from printing the second surface, i.e., 1B, to printing the third surface, i.e., 2A, that is, the adjacent sheet printing interval of the booklet mode as a first period of time, is six sheets. As described, the adjacent sheet printing interval of the booklet mode is longer than the adjacent sheet printing interval of the duplex printing mode.

As described, according to the present embodiment, the adjacent sheet printing interval can be increased from two sheets to six sheets, such that a sufficient time for performing feedback of the detection result of the sensor 30 and utilizing the same to form an image to be printed to the adjacent surface can be ensured. Therefore, image position correction control and image density correction control for a booklet as described in FIG. 4 can be performed, and a high-quality product can be obtained.

Further, the image position correction control and the image density correction control according to the present embodiment related to detecting image deviation and density deviation for each of the preceding sheets. Therefore, it becomes possible to correspond to the image deviation and density deviation of each sheet, such that the image position and the image density can be corrected with higher accuracy.

Furthermore, it may be possible to consider a method for ensuring the time to perform feedback of the detection result of the sensor 30 by lowering the productivity of the printer 100 or elongating the duplex conveyance path 65 so as to increase the number of sheets to be conveyed at the same time within the printer 100, i.e., number of circulating sheets. However, according to such a method, the productivity of the printer 100 is deteriorated or the size of the printer 100 is increased. According to the present embodiment, the positional accuracy and density uniformity of images especially printed to adjacent sheets can be improved while suppressing the deterioration of productivity of the printer 100, such that a high-quality product can be obtained.

Other Embodiments

The above-descried embodiment has illustrated an example in which duplex printing is performed to five sheets in the following processes, but the present technique is not limited thereto. That is, according to the example illustrated above, at first, images are formed to front surfaces of three sheets, 1A to 3A or 1B to 3B in the named order, then images are alternately formed to front and rear surfaces of sheets, before images are finally formed successively to rear surfaces of the last three sheets, which are 3B to 5B or 3A to 5A. However, such duplex printing processes vary according to the size of the printer 100, specifically the length of the conveyance path and the size of the sheets. Therefore, the number of sheets that are conveyed simultaneously within the printer 100 or the printing order thereof can be varied arbitrarily.

According further to the embodiment described above, the five sheets subjected to duplex printing are folded in half such that the fold projects downward, and the center portion is bound by stapling or the like, by which the sheets are subjected to saddle stitch bookbinding, but the present technique is not limited thereto. For example, the present invention is also applicable to a saddle stitch bookbinding in which the fold projects upward, and the bookbinding method is not limited to saddle stitch bookbinding. Further, the number of sheets to be bound is not limited to five sheets, and it can be one to four sheets, or six sheets or greater. In any of the bookbinding methods, the surface that will be arranged adjacent to a succeeding sheet, i.e., adjacent surface, should be printed before printing the other side surface thereof.

Further according to the above-mentioned embodiment, the sensor 30 is arranged downstream of the fixing unit 12 in the sheet conveyance direction CD, but the present technique is not limited thereto. For example, the sensor 30 can be arranged on the reverse guidance path 62, the switchback path 64, or the duplex conveyance path 65.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-149480, filed Sep. 14, 2021, which is hereby incorporated by reference herein in its entirety.

What is claimed is:

1. An image forming apparatus comprising:

an image forming unit configured to form a toner image on a sheet, the image forming unit including an image bearing member configured to bear the toner image, and a transfer unit configured to transfer the toner image borne on the image bearing member;

a fixing unit configured to fix the toner image transferred to the sheet by the transfer unit onto the sheet;

a re-conveyance unit configured to reverse front and rear surfaces of the sheet on which the toner image has been transferred by the transfer unit and to convey the sheet again to the transfer unit;

a detection unit configured to detect an information of the sheet being conveyed; and a control unit configured to execute a booklet mode while creating a booklet, the booklet including a first sheet having a first surface and a second surface opposite to the first surface, and a second sheet having a third surface arranged adjacent to the second surface of the first sheet, the second sheet being conveyed subsequently to the first sheet, wherein the control unit is configured to control the image forming unit such that, in the booklet mode, a toner image is transferred to the second surface before a toner image is transferred to the first surface of the first sheet, and a toner image to be formed on the third surface of the second sheet is corrected based on an information of the second surface detected by the detection unit.

2. The image forming apparatus according to claim 1, wherein the detection unit is arranged downstream of the fixing unit in a sheet conveyance direction.

3. The image forming apparatus according to claim 1, wherein the toner image to be formed on the third surface is not formed on the image bearing member in a state where the first sheet having the toner image formed on the second surface passes through the detection unit.

4. The image forming apparatus according to claim 1, wherein the detection unit includes an image position detecting sensor configured to detect a distance from an edge portion of a sheet to the toner image formed on the sheet, and wherein, in the booklet mode, the control unit is configured to correct a position of the toner image of the third surface formed on the image bearing member based on a detection result of the image position detecting sensor with respect to the second surface.

5. The image forming apparatus according to claim 1, wherein the detection unit includes an image density detecting sensor configured to detect a density of the toner image formed on the sheet, and wherein, in the booklet mode, the control unit is configured to correct a density of the toner image of the third surface formed on the image bearing member based on a detection result of the image density detecting sensor with respect to the second surface.

6. The image forming apparatus according to claim 1, wherein the control unit is configured to execute a duplex printing mode configured to form images on both surfaces of a plurality of sheets that do not constitute a booklet, wherein the plurality of sheets that do not constitute a booklet includes a third sheet having a fourth surface and a fifth surface that is opposite to the fourth surface, and a fourth sheet having a sixth surface arranged adjacent to the fifth surface of the third sheet in a state being supported on the third sheet, the fourth sheet being conveyed subsequently to the third sheet, and wherein a first period of time from when printing is performed to the second surface to when printing is performed to the third surface in the booklet mode is longer than a second period of time from when printing is performed to the fifth surface to when printing is performed to the sixth surface in the duplex printing mode.

7. The image forming apparatus according to claim 1, wherein the second surface is a surface that faces upward when being discharged to an exterior of the image forming apparatus, and wherein the first surface and the third surface are a surface that faces downward when being discharged to the exterior of the image forming apparatus.

8. The image forming apparatus according to claim 1, wherein the re-conveyance unit includes a reverse conveyance path in which front and rear surfaces of a sheet having passed through the fixing unit is reversed, and a re-conveyance path in which the sheet is conveyed from the reverse conveyance path toward the transfer unit, and wherein, in the booklet mode, the control unit is configured to discharge the first and second sheets to which toner images have been formed by the image forming unit to an exterior of the image forming apparatus after reversing front and rear surfaces of the first and second sheets in the reverse conveyance path.

9. The image forming apparatus according to claim 1, wherein the image bearing member is an intermediate transfer belt to which toner images are transferred from a plurality of photosensitive drums.

* * * * *